US009778600B2

(12) United States Patent
Makinodan

(10) Patent No.: US 9,778,600 B2
(45) Date of Patent: Oct. 3, 2017

(54) IMAGE FORMING APPARATUS WITH REMOVABLE INTERMEDIATE TRANSFER BELT

(71) Applicant: CANON KABUSHIKI KAISHA, Tokyo (JP)

(72) Inventor: Jiro Makinodan, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/490,008

(22) Filed: Sep. 18, 2014

(65) Prior Publication Data

US 2015/0078781 A1 Mar. 19, 2015

(30) Foreign Application Priority Data

Sep. 19, 2013 (JP) ..... 2013-193727

(51) Int. Cl.

*G03G 15/00* (2006.01)
*G03G 15/16* (2006.01)
*G03G 21/16* (2006.01)

(52) U.S. Cl.

CPC ..... *G03G 15/1615* (2013.01); *G03G 21/168* (2013.01); *G03G 21/1647* (2013.01); *G03G 2215/0132* (2013.01)

(58) Field of Classification Search

CPC ..... G03G 15/1615; G03G 21/1647; G03G 21/168; G03G 2215/0132
USPC ..... 399/121, 80, 302, 308
See application file for complete search history.

(56) References Cited

U.S. PATENT DOCUMENTS

| | | | | |
|---|---|---|---|---|
| 8,660,463 | B2 | 2/2014 | Takeshita | |
| 2006/0072929 | A1* | 4/2006 | Takahashi | G03G 21/1647 399/13 |
| 2011/0097110 | A1* | 4/2011 | Takeshita | 399/121 |
| 2012/0219317 | A1* | 8/2012 | Kato | 399/110 |

FOREIGN PATENT DOCUMENTS

| | | | |
|---|---|---|---|
| JP | 2010-204250 | A | 9/2010 |
| JP | 2011-095393 | A | 5/2011 |
| JP | 2011-191459 | A | 9/2011 |

* cited by examiner

*Primary Examiner* — David M Gray
*Assistant Examiner* — Andrew V Do
(74) *Attorney, Agent, or Firm* — Fitzpatrick, Cella, Harper & Scinto

(57) ABSTRACT

An image forming apparatus includes a belt unit capable of being inserted into and pulled out of the apparatus, the belt unit including a movable endless belt, a supporting frame supporting the endless belt and having an accommodating portion, a grip member which is provided on the supporting frame at a position outside the belt in a widthwise direction of the belt that is orthogonal to a moving direction of the belt and which is movable between a first position in which the grip member is projected out of the accommodating portion in a direction orthogonal to the widthwise direction and a second position in which the grip member is accommodated in the accommodating portion, and an urging member configured to urge the grip member in a direction from the second position toward the first position.

10 Claims, 8 Drawing Sheets

(a)

(b)

(a)

(b)

IMAGE FORMING APPARATUS WITH REMOVABLE INTERMEDIATE TRANSFER BELT

FIELD OF THE INVENTION AND RELATED ART

The present invention relates to an image forming apparatus, such as a copying machine, a facsimile machine, and a printer, which is equipped with an endless belt, an endless belt unit, or the like.

In recent years, an image forming apparatus, such as a copying machine or a printer, which uses an electrophotographic image forming method, has been substantially increased in operational speed. With the increase in operational speed, an image forming apparatus which has multiple image forming sections, and is structured so that the multiple image forming sections oppose an endless belt and simultaneously carry out their image formation processes, which are different in image color, has become the mainstream apparatus. One of the representative examples of such an image forming apparatus is a full-color image forming apparatus which employs an intermediary transfer belt. In the case of an image forming apparatus which employs an intermediary transfer belt, multiple toner images, different in color, are sequentially transferred in layers onto the intermediary transfer belt (primary transfer) to effect a full-color toner image on the intermediary transfer belt, and then, the multiple toner images, different in color, of which the full-color toner image is made up, are transferred together onto recording medium (secondary transfer).

Also in the case of an image forming apparatus, such as the one described above, which employs an intermediary transfer belt, if its intermediary transfer belt is shorter in the length of service life than the main assembly of the image forming apparatus, it has to be periodically replaced. Generally speaking, an operation for replacing the intermediary transfer belt in an image forming apparatus is carried out after the intermediary transfer belt unit which contains the intermediary transfer belt is moved out of the main assembly of the image forming apparatus. An example of a widely used method for replacing the intermediary transfer belt unit is such a method that the intermediary transfer belt unit is pulled out of the main assembly of the image forming apparatus through one of the lateral walls of the main assembly, in the direction perpendicular to the lateral wall, and then, a replacement intermediary transfer belt unit (possibly new) is inserted into the main assembly.

Generally speaking, in the case of the intermediary transfer belt unit used by the above-described method, it is provided with a pair of handles to make it easier to be lifted by an operator. For example, in the case of the intermediary transfer belt unit proposed in Japanese Laid-open Patent Application 2011-191459, its handle is above the intermediary transfer belt 33*b* suspended and kept tensioned by multiple rollers. In terms of the width direction of the intermediary transfer belt, it is centrally located. The handle of this intermediary transfer belt unit is made up of a pair of curved and protrusive linkage portions, and a handgrip portion which bridges between the pair of linkage portions.

By the way, in the case of the intermediary transfer belt unit disclosed in Japanese Laid-open Patent application 2011-191459, the handle is above the intermediary transfer belt. Therefore, a storage space for the handle is necessary above the unit. Therefore, the unit is increased in height by the components for the handle storage space.

Therefore, in the case of an image forming apparatus which employs a conventional intermediary transfer belt unit, it is necessary to secure a relatively large space for storing a tall intermediary transfer unit, which is problematic in that securing the large space makes it necessary to increase the main assembly of the image forming apparatus in height.

SUMMARY OF THE INVENTION

According to an aspect of the present invention, there is provided an image forming apparatus comprising a main assembly; a belt unit capable of being inserted into and pulled out of said main assembly, said belt unit including a movable endless belt, a supporting frame supporting said endless belt and having an accommodating portion, a grip member which is provided on said supporting frame at a position outside said belt in a widthwise direction of said belt crossing with a moving direction of said belt and which is movable between a first position in which said grip member is projected out of said accommodating portion in a direction crossing with the widthwise direction and a second position in which said grip member is accommodated in said accommodating portion, and an urging member configured to urge said grip member in a direction from the second position toward the first position; an image forming unit provided in said main assembly configured to form an image on said belt; a guiding rail provided in said main assembly and configured to guide said belt unit when said belt unit is inserted into said main assembly; and a contact member provided in said main assembly and configured to be contacted by said grip member to move said grip member from the first position to the second position in midstream of the insertion of said belt unit into said main assembly while being guided by said guiding rail and configured to be disengaged from said grip member to permit said grip member to move from the second position to the first position by an urging force of said urging member in the midstream of the pulling-out of said belt unit while being guided by said guiding rail.

Further features of the present invention will become apparent from the following description of exemplary embodiments with reference to the attached drawings.

DESCRIPTION OF THE PREFERRED EMBODIMENTS

Hereinafter, embodiments of a belt device in accordance with the present invention, and embodiments of an image forming apparatus equipped with a belt device in accordance with the present invention, are described with reference to appended drawings. By the way, if a component in a drawing has the same referential code as a component in another drawing, the two components are the same, or similar to each other.

The following embodiments of the present invention are related to cases in which the present invention was applied to a belt device 102 having an intermediary transfer belt unit 103 as a belt unit. However, these embodiments are not intended to limit the present invention in scope. That is, not only is the present invention applicable to the belt device 102, but also, other belt devices which are removably installable in the main assembly of an image forming apparatus. More specifically, the present invention is applicable to any belt device which is structured so that its endless belt for conveying sheets of recording medium is circularly moved, and is removably installable in the main assembly of an image forming apparatus.

Figure 1:
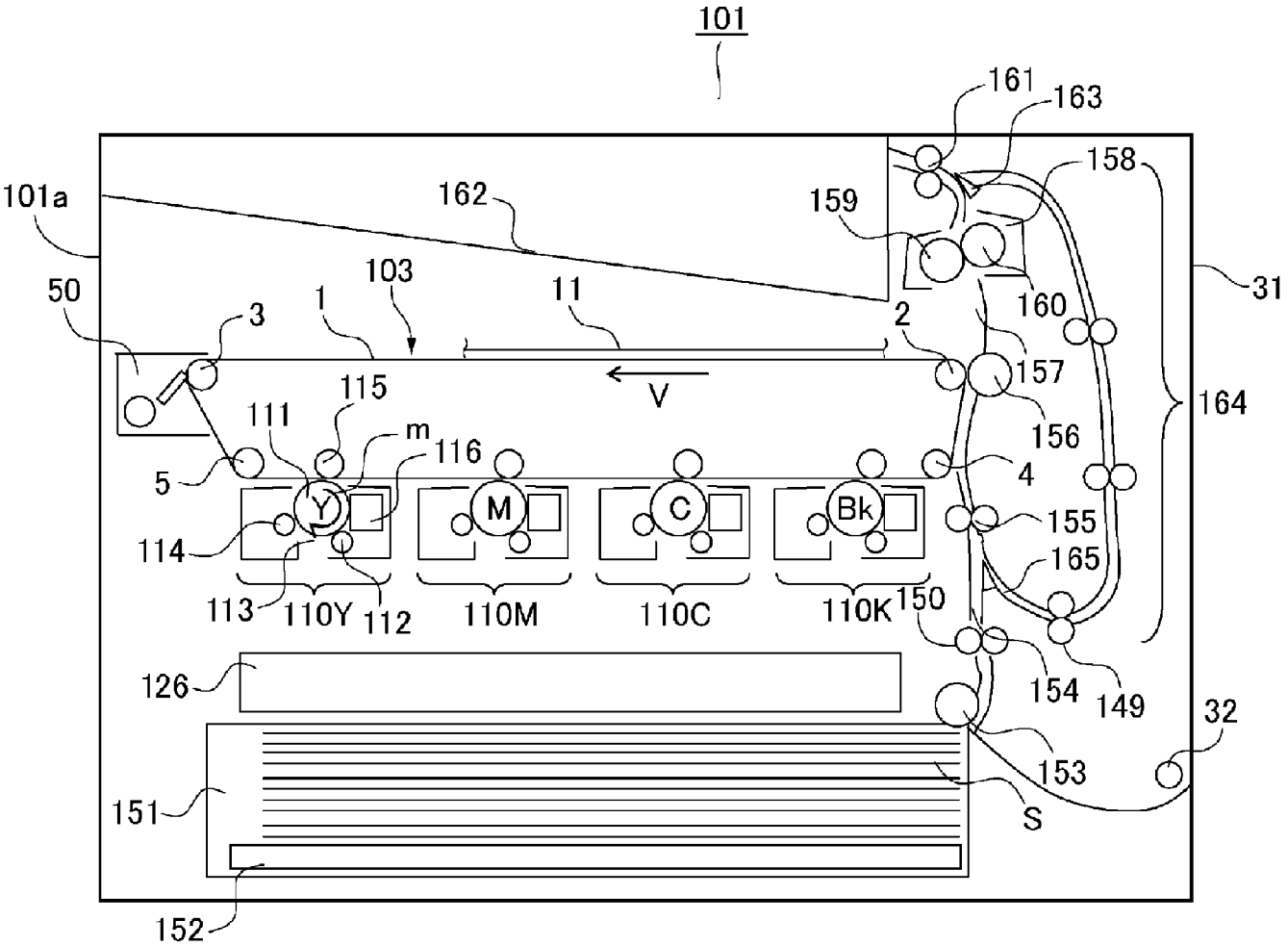
FIG. 1 is a sectional view of a typical image forming apparatus of the intermediary transfer type, which is compatible with the present invention.
Figure 2:
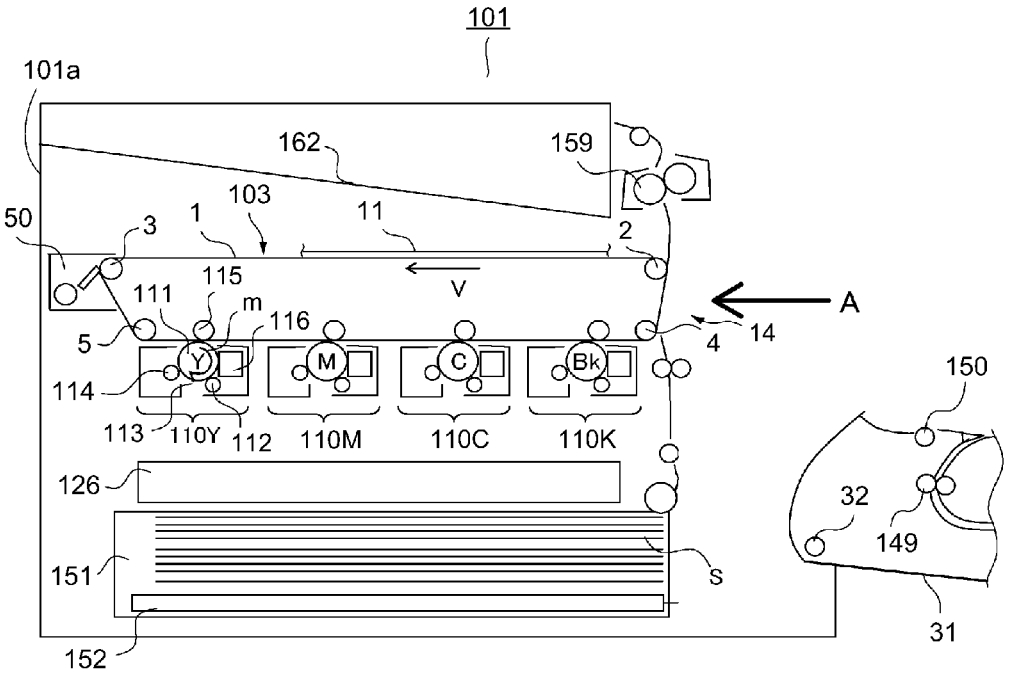
In FIG. 2, part (a) is a sectional view of the image forming apparatus in the first embodiment of the present invention when the door of the apparatus is open, and part (b) is a schematic sectional view of the image forming apparatus as seen from the direction indicated by an arrow mark A.
Figure 2:
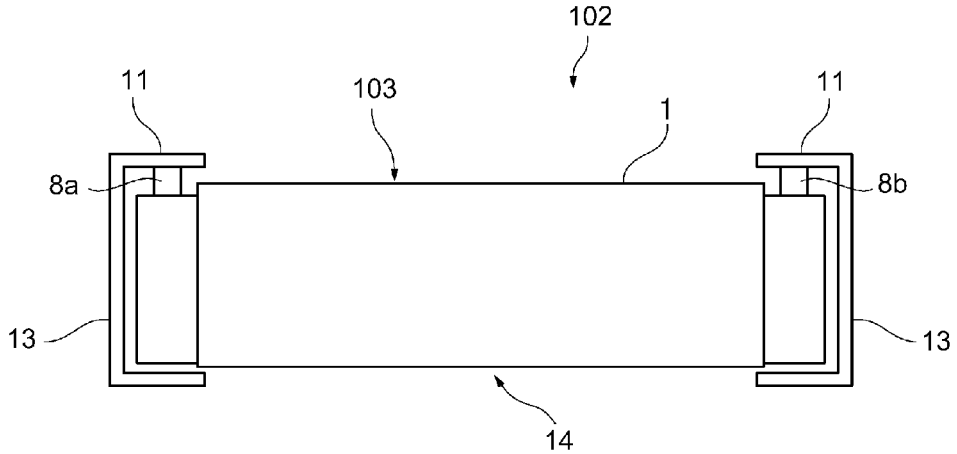

First, referring to FIGS. 1 and 2, the image forming apparatus 101 in the following embodiment of the present invention is described. There are various image forming methods, for example, an electrophotographic method, an offset printing method, an inkjet method, etc., which can be employed by an image forming apparatus. However, the image forming apparatus 100 shown in FIGS. 1 and 2 is a full-color image forming apparatus which uses an electrophotographic method. FIG. 1 is a sectional view of the image forming apparatus 101 when the door of the apparatus is closed. In FIG. 2, part (a) is a sectional view of the image forming apparatus 101 when the door of the apparatus is open. In FIG. 2, part (b) is a schematic sectional view the image forming apparatus 101 as seen from the direction indicated by the arrow mark A.

This image forming apparatus 101 is of the so-called intermediary transfer type, and also, of the so-called tandem type. More specifically, it has: four image forming sections, which are different in the color of the images they form; and an intermediary transfer belt 1, which is a circularly movable endless belt. It is structured so that the four image forming sections are arranged in tandem, and in contact with the top side of the intermediary transfer belt 1. This type of image forming apparatus is capable of forming an image on cardstock, and also, is excellent in productivity. Therefore, it has become the main stream image forming apparatus in recent years.

[Recording Medium Conveyance Process]

Referring to FIG. 1, the image forming apparatus 101 has a main assembly 101*a* (which hereafter will be referred to simply as "apparatus main assembly"). The right end of the apparatus main assembly 101*a* is provided with a door 31 which is opened or closed to remove jammed sheets of paper, or to insert or extract the belt device 102. The door 31 is pivotally movable in the clockwise and counterclockwise direction of FIG. 1, about a pivotal shaft 32, as a pivot, with which the bottom-right portion of the apparatus main assembly 101*a* is provided. When the door 31 is open, it remains in the state shown in part (a) of FIG. 2.

The detailed description of the belt device 102 having the intermediary transfer belt unit 103 is given later. Referring to part (b) of FIG. 2, the belt device 102 is inserted into its designated position (shown in part (a) of FIG. 2) in the apparatus main assembly 101*a*, through a guiding passage 14 with a pair of components 13 and 13 formed of sheet metal and fixed to the front and rear ends (with reference to FIG. 1) of the apparatus main assembly 101*a*. It is also though this guiding passage 14 that the belt device 102 is pulled out of the apparatus main assembly 101*a*.

The components 13 and 13 formed of sheet metal have handle pressing portions 11 and 11, one for one, formed by bending a part of each of the components 13 and 13 formed of sheet metal in such a manner that the bent part faces the belt device 102. As for the belt device 102, it is provided with a pair of handles 8*a* and 8*b*. As the belt device 102 is inserted into the apparatus main assembly 101*a*, the handles 8*a* and 8*b* are pressed into handle retreats (second position), one for one, by the handles pressing portions 11 and 11. Further, when the belt device 102 is in the abovementioned designated position in the apparatus main assembly 101*a*, the handles 8*a* and 8*b* are kept in their retreats (second position) by the handle pressing portion 11 and 11.

Incidentally, in this embodiment, the handle pressing portions 11 are parts of the front and rear components 13 and 13 formed of sheet metal, one for one. However, if the apparatus main assembly 101*a* is such that the space on the top side of the guiding passage 14 is large enough to accommodate the belt device 102, with one of the handles 8*a* and 8*b* remaining protrusive, it may be only one of the front and rear components 13 formed of sheet metal that is provided with the handle pressing portion 11.

Sheets S of recording medium are stored in layers on the sheet lifting device 152 in the recording medium holding portion 151 of the image forming apparatus 101. The sheets S are fed, in synchronism with image formation timing, into the apparatus main assembly 101*a* (and conveyed) by a sheet feeder roller 153 which is at the top-downstream edge of the recording medium storing portion 151, in terms of the recording medium conveyance direction. The image feeding method does not need to be limited to the one used by the image forming apparatus 101 in this embodiment; a method other than the one used in this embodiment may be used.

After being fed into the apparatus main assembly 101*a* by the sheet feeder roller 153, each sheet S of recording medium is conveyed to a pair of registration rollers 155 through a recording medium feeding/conveying passage 154. Then, the sheet S is corrected in attitude and/or conveyance timing by the pair of registration rollers 155, and then, sent to the secondary transfer portion, which is the transfer nip formed by a secondary transfer roller 2 which is on the inward side of the belt loop the intermediary transfer belt 1 forms, and drives the belt, and a secondary transfer roller 156 which is on the outward side of the belt loop. As a preset amount of pressure and a preset electrostatic bias are applied to this secondary transfer portion, the toner image (image formed of toner) on the intermediary transfer belt 1 is transferred onto the sheet S of recording medium.

[Image Formation Process]

Next, an image formation process which is carried out while a sheet S of recording medium is conveyed from the recording medium storage portion 151 to the secondary transfer portion is described.

The image forming apparatus 101 has image forming sections 110Y, 110M, 110C, and 110K, each of which forms a toner image on the intermediary transfer belt 1 (endless belt) while the belt is circularly moved. The image forming section 110Y forms an image with the use of yellow (Y)-colored toner, and the image forming section 110Y forms an image with the use of magenta (M)-colored toner. The image forming section 110C forms an image with the use of cyan (C)-colored toner, and the image forming section 110K forms an image with the use of black (Bk)-colored toner.

By the way, although the image forming sections 110Y, 110M, 110C and 110K are different in the color of the toner they use, they are similar in structure. Therefore, only the image forming section 110Y is described, as a representative of the four portions, about its content.

The image forming section 110Y has: a photosensitive drum 111 as an image bearing member; a charging device 112 which charges the photosensitive drum 111; an exposing device 113; a developing device 114; a primary transferring device 115; and a photosensitive drum cleaning device 116. As the photosensitive drum 111 is rotated in the direction indicated by an arrow mark m in FIG. 1, it is uniformly charged across its peripheral surface by the charging device 112.

A beam of laser light is outputted, while being modulated with image signals, from a scanner unit 126 which includes a laser, a polygon mirror, and a corrective lens system, is reflected by a mirror, and exposes the uniformly charged portion of the peripheral surface of the photosensitive drum 111, in the exposing section. Consequently, an electrostatic latent image is effected on the peripheral surface of the photosensitive drum 111. Then, the electrostatic latent image on the photosensitive drum 111 is developed by the developing device 114 into a toner image, on the photosensitive drum 111.

Thereafter, the yellow toner image is transferred onto the intermediary transfer belt 1 by the primary transferring device 115 to which a preset amount of pressure, and a preset electrostatic bias, are being applied. Transfer residual toner, or the toner remaining on the photosensitive drum 111 after the transfer, is recovered by the photosensitive member cleaning device 116, to prepare the photosensitive drum 111 for the next image formation.

The above-described image forming apparatus is provided with four image forming sections 110 (110Y, 110M, 110C, and 110B). Therefore, a magenta toner image formed by image forming section 110M is transferred onto the intermediary transfer belt 1 in such a manner that it is laid upon the yellow toner image which was formed by the image forming section 110M and transferred onto the intermediary transfer belt 1. Then, a cyan toner image formed by the image forming section 110C is transferred onto the intermediary transfer belt 1, in such a manner that it is laid upon the magenta toner image on the intermediary transfer belt 1. Further, a black toner image formed by the image forming section 110K is transferred onto the intermediary transfer belt 1 in such a manner that it is laid upon the cyan image on intermediary transfer belt 1.

As the four toner images, different in color, are sequentially formed in layers on the intermediary transfer belt 1, a full-color image is effected on the intermediary transfer belt 1. By the way, a full-color image formed by the image forming apparatus 101 in this embodiment is made up of four monochromatic images, which are different in color. However, the number of the primary colors of which a full-color is to be effected does not need to be limited to four. Further, the order in which multiple monochromatic images, different in color, are to be formed does not need to be limited to that in which the monochromatic images are formed by the image forming apparatus 101 in this embodiment.

[Intermediary Transfer Belt]

Next, referring to FIG. 1, the intermediary transfer belt 1 is described in detail. The intermediary transfer belt 1 is suspended and kept tensioned by the belt driving roller 2, which doubles as the internal secondary transfer roller, a tension roller which provides the intermediary transfer belt 1 with a preset amount of tension, and idler rollers 4 and 5 as auxiliary tension rollers. The intermediary transfer belt 1 is circularly moved (conveyed, driven) in the direction indicated by an arrow mark V.

The image formation processes, different in the color of the toner, are carried out by the above-described image forming sections 110Y, 110M, 110C and 110K, one for one, with such a timing that a toner image formed by a downstream image forming section 110 is transferred (primary transfer) onto the intermediary transfer belt 1 with such a timing that it is laid upon the image transferred onto the intermediary transfer belt 1 by an upstream image forming section 110. Consequently, a full-color toner image is effected on the intermediary transfer belt 1, and is conveyed to the secondary transfer section. Incidentally, the number of rollers by which the intermediary transfer belt 1 is suspended and kept tensioned does not need to be limited to the number of rollers by which the intermediary transfer belt 1 is suspended and kept tensioned in the image forming apparatus 101 structured as shown in FIG. 1.

[Image Formation Processes Carried Out after Secondary Transfer Process]

After the above-described image formation process, and process for conveying a sheet S of recording medium, are carried out with the above-described timing, the full-color toner image on the intermediary transfer belt 1 is transferred (secondary transfer) onto a sheet S of recording medium, in the secondary transfer section.

Thereafter, the sheet S is conveyed by a pre-fixation conveying portion 157 to a fixing device 158. There are various fixing devices which are different in structure and/or fixing method. However, the fixing device 158, shown in FIG. 1, is of such a type that weld (fix) a toner image to a sheet S of recording medium by applying a preset amount of pressure and a preset amount of heat to the sheet S and the unfixed toner image thereon, in the fixation nip formed by a fixation roller 159 and a pressure roller 160, which oppose each other.

In the case of the fixing device 158 in this embodiment, the fixing device 158 is equipped with a heater as a heat source which is disposed in the hollow of the fixation roller 159, and the pressure roller 160 is kept pressed against the fixation roller 159. The sheet S is conveyed through the fixing device 158, and conveyed to a pair of discharge-reversal rollers 161. Then, it is discharged straight onto a delivery tray 162, or guided by a sheet directing device 163 to a sheet conveying device 164 for two-sided image formation. When it is necessary to form an image on both surfaces of a sheet S of recording medium, the sheet S is switch-backed by the discharge-reversal rollers 161 so that the sheet edge, which was the downstream edge while an image is formed on the first surface of the sheet, becomes the upstream edge. Then, the sheet S is conveyed to the sheet conveying device 164 for two-sided image formation.

Thereafter, it is conveyed into the sheet feeding/conveying passage 154 through a sheet re-feeding passage 165, with such a timing that it does not interfere with the conveyance of the next sheet S of recording medium sent and conveyed by the sheet feeder roller 153 to form the next image. Then, it is sent to the second transferring portion as it was to form an image on its first surface. The process for forming an image on the back surface (second surface) of the sheet S is similar to the above-described process for forming an image on its front (first) surface, and therefore, is not described. The toner which failed to be transferred (secondary transfer) from the intermediary transfer belt 1 onto the sheet S, and therefore, is remaining on the intermediary transfer belt 1 after the secondary transfer is removed by the intermediary transfer belt cleaner 50, which is kept in contact with the intermediary transfer belt 1.

[Structure of Handle Section of Intermediary Transfer Belt Unit]

Figure 3:
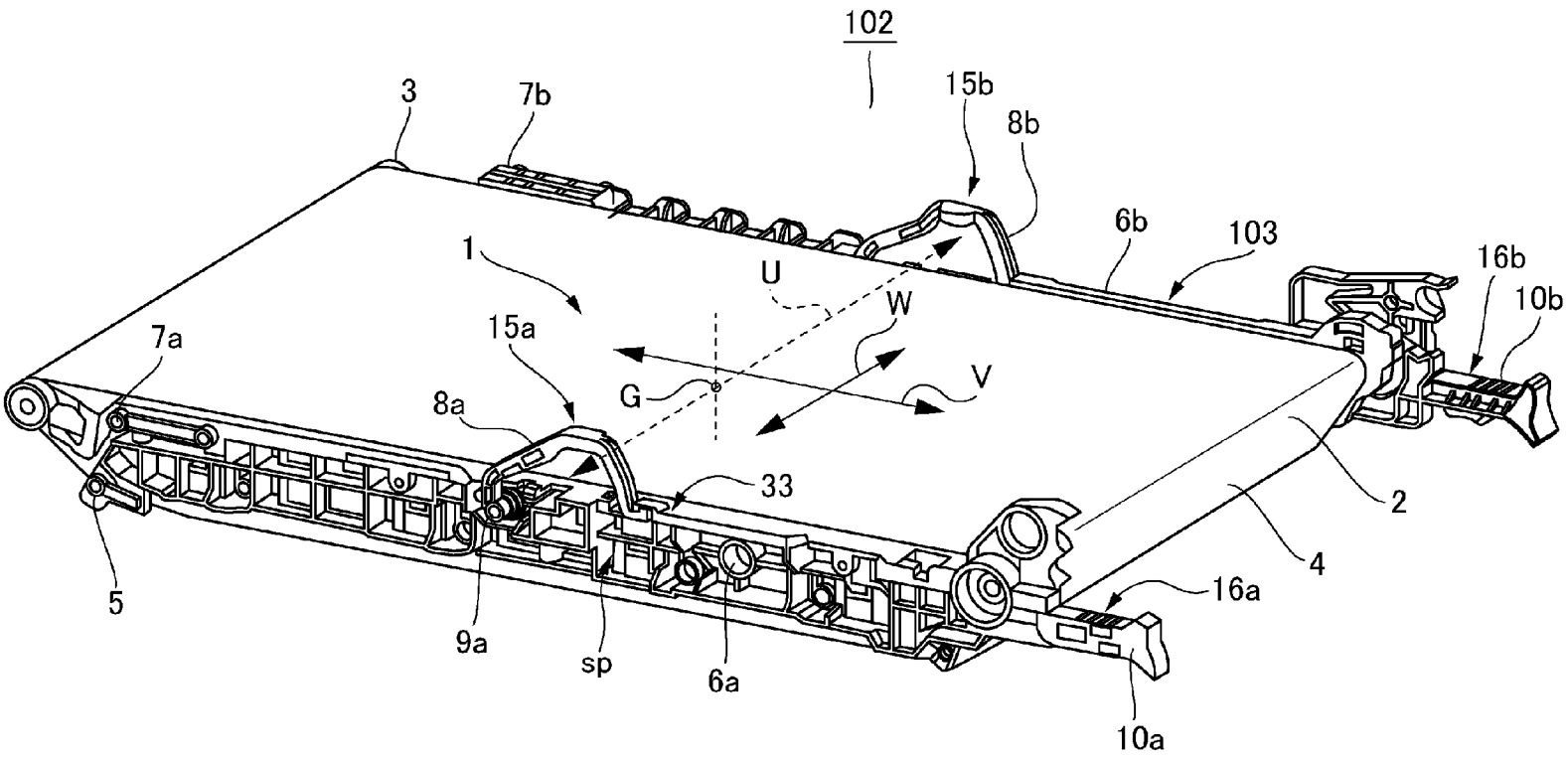
FIG. 3 is a perspective view of the entirety of the intermediary transfer belt unit in the first embodiment.
Figure 4:
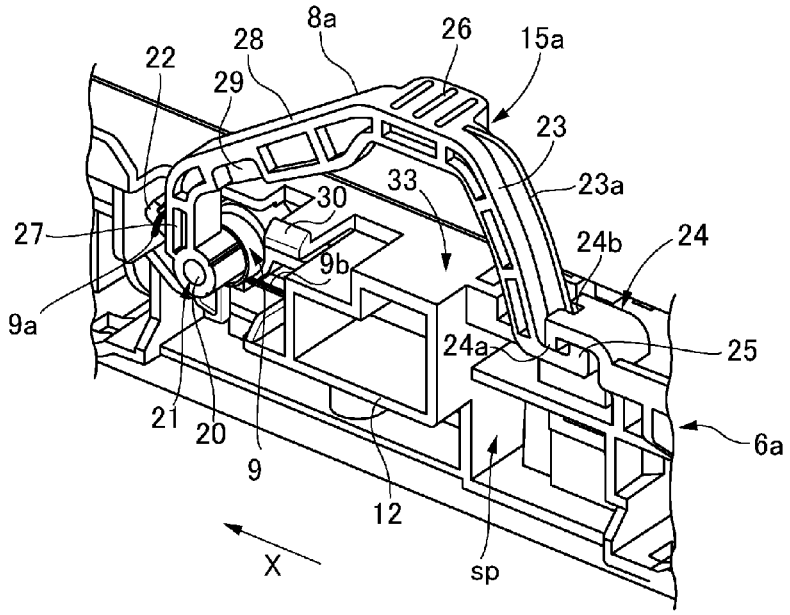
In FIG. 4, part (a) is an enlarged perspective view of the intermediary transfer belt unit conveyance handle, and its adjacencies, in the first embodiment, when the handle is entirely protruding, and part (b) is an enlarged plan view of the intermediary transfer belt unit conveyance handle, and its adjacencies, when the handle is entirely in the intermediary transfer belt unit.
Figure 4:
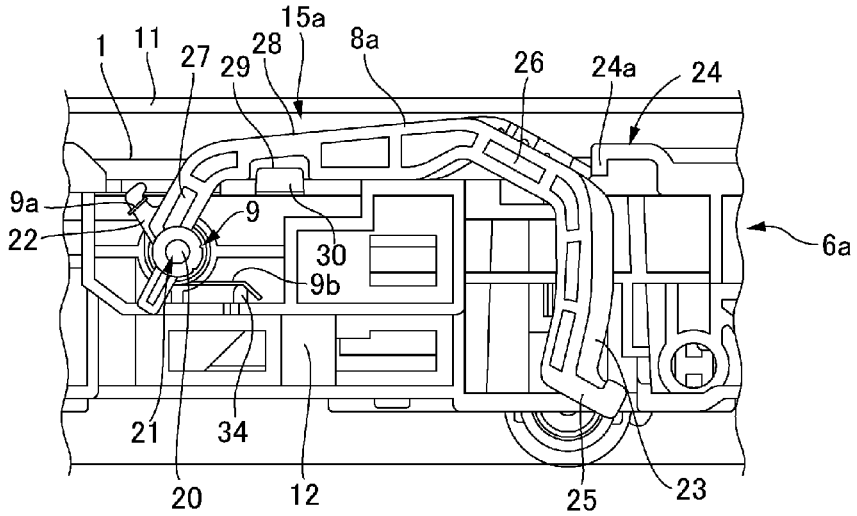

Next, referring to FIG. 3 and parts (a) and (b) of FIG. 4, a pair of handle sections 15*a* and 15*b* of the belt device 102, which are for transporting the belt device 102, and a pair of handle sections 16*a* and 16*b*, which are for inserting the belt device 102 into the apparatus main assembly 101*a*, or extracting the belt device 102 from the apparatus main assembly 101*a*, are described about their structure. FIG. 3 is a perspective view of the entirety of the belt device 102 which the image forming apparatus 101 has. Part (a) of FIG. 4 is an enlarged perspective view of the transportation handle section 15*a* when the handle section 15*a* is in its outside position, and part (b) of FIG. 4 is an enlarged front view of the transportation handle section 15*a* when the handle section 15*a* is in its inside position.

Referring to FIG. 3, the belt device 102 has the intermediary transfer belt unit 103, which is a belt unit structured so that it can be inserted into, or extracted from, the apparatus main assembly 101*a*. The intermediary transfer belt unit 103 has a pair of support frames 6*a* and 6*b*, which support the intermediary transfer belt 1 and are provided with a storage portion 33. Further, the intermediary transfer belt unit 103 has the pair of transportation handle sections 15*a* and 15*b*, which are outwardly offset from the main assembly of the intermediary transfer belt unit 103, in the belt width direction (indicated by arrow mark W) which is intersectional (perpendicular) to the direction in which the intermediary transfer belt 1 is circularly moved. Further, the support frames 6*a* and 6*b* are provided with handle sections 16*a* and 16*b*, respectively, for inserting the belt device 102 into the apparatus main assembly 101*a*, or extracting the belt device from the apparatus main assembly 101*a*. Further, the storage portion 33 with which each of the support frames 6*a* and 6*b* is provided has a storage space sp.

The above-described support frames 6*a* and 6*b* are at the ends, one for one, of the intermediary transfer belt unit 103, in terms of the belt width direction (indicated by arrow mark W) which is intersectional (perpendicular) to the direction (indicated by arrow mark V in FIG. 3) in which the belt device 102 is inserted into, or extracted from, the apparatus main assembly 101*a*. The two support frames 6*a* and 6*b* are connected to each other by an unshown frame, which is on the inward side of the loop which the intermediary transfer belt 1 forms.

The aforementioned belt driving roller 2 (which also functions as inward secondary transfer roller), tension roller 3, auxiliary tension roller 4, and auxiliary tension roller 5 are supported by the support frames 6*a* and 6*b*, by their lengthwise end portions. The support frames 6*a* and 6*b* are partially protrusive outward from the intermediary transfer belt 1. Further, the downstream end portions of the support frames 6*a* and 6*b*, in terms of the direction (indicated by arrow mark X in part (a) of FIG. 4) in which the belt device 102 is inserted are provided with guide bosses 7*a* and 7*b*, respectively, by which the support frames 6*a* and 6*b* are guided by the guide rails 13 and 13 of the apparatus main assembly 101*a*, which are made of sheet metal.

Referring to FIG. 3, and parts (a) and (b) of FIG. 4, the transportation handle sections 15*a* and 15*b* have handles 8*a* and 8*b*, respectively, which are roughly outwardly curved. The belt device 102 is structured to enable the transportation handle sections 15*a* and 15*b* to move out of the storage portion 33 in such a manner that the handles 8*a* and 8*b* move into their outside position (first position) in which the handles 8*a* and 8*b* are protrusive from the main assembly of the belt device 102, and also, that the handles 8*a* and 8*b* move into their retreat, or inside position (second position) in which they remain in the storage portion 33. Further, the transportation handle sections 15*a* and 15*b* have a torsion coil spring 9 (only coil spring 9 of transportation handle section 15*a* is shown, for convenience sake), as a pressure applying means for keeping the transportation handle sections 15*a* and 15*b* pressured in the direction (handle erecting direction) to move the handles 8*a* and 8*b* from their inside position (second position) to the outside position (first position).

The storage portions 33 are compartmentalized by the support frames 6*a* and 6*b*, and have ribs 12 which are for strengthening the frames 6*a* and 6*b* and correspond in position to the bottom portion of the curved portions 26 of the handles 8*a* and 8*b*. Incidentally, a referential code 30 in parts (a) and (b) of FIG. 4 stands for a protrusion with which the support frames 6*a* and 6*b* are provided. The protrusion 30 is made to temporarily engage into a recess 29, with which the handles 8*a* and 8*b* are provided, during the operation for attaching the handles 8*a* and 8*b* to the support frames 6*a* and 6*b*.

In terms of the direction in which the belt device 102 is inserted into, or extracted from, the apparatus main assembly 101*a*, the handles 8*a* and 8*b* are located at the middle of the support frames 6*a* and 6*b*, respectively. They are pivotally supported at roughly the center of gravity of the belt device 102 so that they are allowed to vertically emerge (come out) from, or submerge (retract) into, the main assembly of the belt device 102. They are kept pressed by the torsion coil spring 9 in the direction to emerge in the vertical direction. One end 9*a* of the torsion coil spring 9 is in engagement with a protrusion 22 of the corresponding end portion 27 of the handles 8*a* and 8*b*, whereas the other end 9*b* of the torsion coil spring 9 is in engagement with the coil spring engaging portions 34 of the support frames 6*a* and 6*b*. The torsion coil spring 9, which is an elastic member, makes up a pressing means for keeping the handles 8*a* and 8*b* pressed in the direction to move the handles 8*a* and 8*b* from the inside position (second position) to the outside position (first position).

As the intermediary transfer belt unit 103 is inserted into the apparatus main assembly 101*a* in the direction indicated by the arrow mark X, shown in part (a) of FIG. 4, the handles 8*a* and 8*b* move to their inside position while remaining engaged with the handle pressing portion 11, which is a part of the apparatus main assembly 101*a*. On the other hand, as the intermediary transfer belt unit 103 is pulled out of the apparatus main assembly 101*a*, the handles 8*a* and 8*b* are released from the handle pressing portions 11, and therefore, move into the outside position, making it easier for an operator to transport the intermediary transfer belt unit 103.

That is, the handles 8*a* and 8*b* make it easier for the belt device 102 to be transported by an operator when the belt device 102 is out of the apparatus main assembly 101*a*. If an operator wants to grasp the handles 8*a* and 8*b* to transport the belt device 102, the operator is to insert his or her fingers into the space between the curved portion 26 of the handles 8*a* and 8*b*, and the support frames 6*a* and 6*b*, grasp the handles 8*a* and 8*b*, and then, lift the belt device 102. In order to increase the space between the curved portion 26 and corresponding support frames 6*a* and 6*b* to make it easier to grasp the curved portion 26, the end portion 27 of each of the handles 8*a* and 8*b*, which is between the pivotal shaft 20 and curved portion 26, is given an appropriate length.

Further, the transport handle sections 15*a* and 15*b* are pivotally supported by the pivotal shaft 20 (FIG. 4 shows only transportation handle section 15*a*), by their end portion 27. The pivotal shaft 20 which pivotally supports the transportation handle section 15*a* (15*b*) is parallel to the belt width direction (indicated by arrow mark W in FIG. 3), which is intersectional to the rotational direction of the intermediary transfer belt 1. Further, the transportation handle section 15*a* (15*b*) has a guide engaging portion 24, which not only guides the handle 8*a* (8*b*) by the other end 23 of the handle 8*a* (8*b*) while the handle 8*a* (8*b*) moves between its outside position and inside position, but also, keeps the handle 8*a* (8*b*) locked in the outside position to make it possible for the handle 8*a* (8*b*) to be used for transporting the belt device 102. The pivotal shaft 20 is provided with a disengagement prevention pawl (unshown) for preventing the handle 8*a* and 8*b* from becoming disengaged from the support frames 6*a* and 6*b*, respectively.

The transportation handle sections 15*a* and 15*b* are located at the outward ends (side) of the support frames 6*a* and 6*b* in terms of the belt width direction (indicated by arrow mark W). Further, they are roughly symmetrically positioned with reference to the line which is parallel to the lateral edges of the belt device 102 and coincides with the center G of gravity of the intermediary transfer belt unit 103. Therefore, the belt device 102 in this embodiment is excellent in terms of the weight balance when an operator transports the belt device 102 by grasping the handles 8*a* and 8*b*.

Each of the handles 8*a* and 8*b* has the curved portion 26, which is between the downstream end portion 27 and upstream end portion of the handle 8*a* (8*b*), in terms of the direction in which the intermediary transfer belt unit 103 is inserted into the apparatus main assembly 101*a*, and is curved in a manner of protruding from the inside position (second position) to the outside position (first position). The abovementioned pivotal shaft 20 is at the downstream end of the handle 8*a* (8*b*) in terms of the direction in which the belt device 102 is inserted into the apparatus main assembly 101*a*. Therefore, the handle 8*a* (8*b*) can be smoothly pushed into the inside position while causing the slanted surface of the handle 8*a* (8*b*), which is between the downstream end portion 27 and curved portion 26, to slide on the end portion 11*a* (FIG. 5) of the handle pressing portion 11.

While the belt device 102 is in the apparatus main assembly 101*a*, the handle 8*a* (8*b*) is under the pressure applied from above by the handle pressing portion 11 of the apparatus main assembly 101*a*. Therefore, it remains in the storage space sp in the support frame 6*a* (6*b*) (part (b) of FIG. 4). In this case, the position of the handle 8*a* (8*b*) in the storage space sp of the support frame 6*a* (6*b*) in terms of the height of the intermediary transfer belt unit 103 is roughly the same as the intermediary transfer belt 1. In other words, this embodiment can reduce the belt device 102 in overall height.

Further, the storage space sp of the storage portion 33 is positioned so that the support frame 6*a* (6*b*) does not interfere with the rotational movement of the upstream end portion 23 of the handle 8*a* (8*b*). Therefore, in the case of the belt device 102 in this embodiment, it is unnecessary for a storage space for the handle 8*a* (8*b*) to be provided above the intermediary transfer belt 1, unlike in the case of a belt device based on conventional technologies.

Further, the guide engaging portion 24 has: a protrusion 24*a* which engages with the protrusion 25, with which the upstream end portion 23 of the handle 8*a* (8*b*) is provided, and keeps the handle 8*a* (8*b*) in the support frame 6*a* (6*b*) compartmentalized to provide the storage portion 33. The protrusion 24*a* has a guiding groove 24*b* which guides the protrusive portion 23*a* of the upstream end portion 23, by which the handle 8*a* (8*b*) is guided by the guiding groove 24*b*.

The belt device 102 is structured so that as the handle 8*a* (8*b*) is pivotally moved, the protrusive portion 23*a* of the upstream protrusion 23 of the handle 8*a* (8*b*) is guided by the guiding groove 24*b* of the support frame 6*a* (6*b*). Further, the protrusive portion 23*a* is given a curvature, the center of which coincides with the axial line of the pivotal shaft 20. Therefore, the protrusive portion 23*a* can smoothly slide in the guiding groove 24*b*. As the handle 8*a* (8*b*) is allowed to be made to erect out of the support frame 6*a* (6*b*) by the torsion spring 9, it pivots until it engages with the protrusion 24*a*.

The handle 8*a* of the support frame 6*a* and the handle 8*b* of the support frame 6*b*, are shaped the same, and positioned so that they remain symmetrically positioned whether they are completely out of, or in, the support frames 6*a* and 6*b*, respectively. Further, the aforementioned insertion-extraction handle sections 16*a* and 16*b* are provided with handles 10*a* and 10*b*, which are on the downstream side of the insertion-extraction handle sections 16*a* and 16*b* in terms of the direction in which the belt device 102 is pulled out of the apparatus main assembly 101*a*.

In other words, the insertion-extraction handle sections 16*a* and 16*b* are attached to the support frames 6*a* and 6*b* in such a manner that they can be grasped by a user when the belt device 102 is inserted or extracted. The direction in which the belt device 102 is extracted from the apparatus main assembly 101*a* is parallel to the surface on which the apparatus main assembly 101*a* is placed. Therefore, the operation for guiding belt device 102 to the unit guiding rails 13 and 13 formed of sheet metal, in the apparatus main assembly 101*a*, and inserting the belt device 102 into the apparatus main assembly 101*a*, or the operation for extracting the belt device 102 from the apparatus main assembly 101*a*, can be simply carried out by grasping the handles 10*a* and 10*b*.

[Insertion of Intermediary Transfer Belt Unit into Apparatus Main Assembly]

Figure 5:
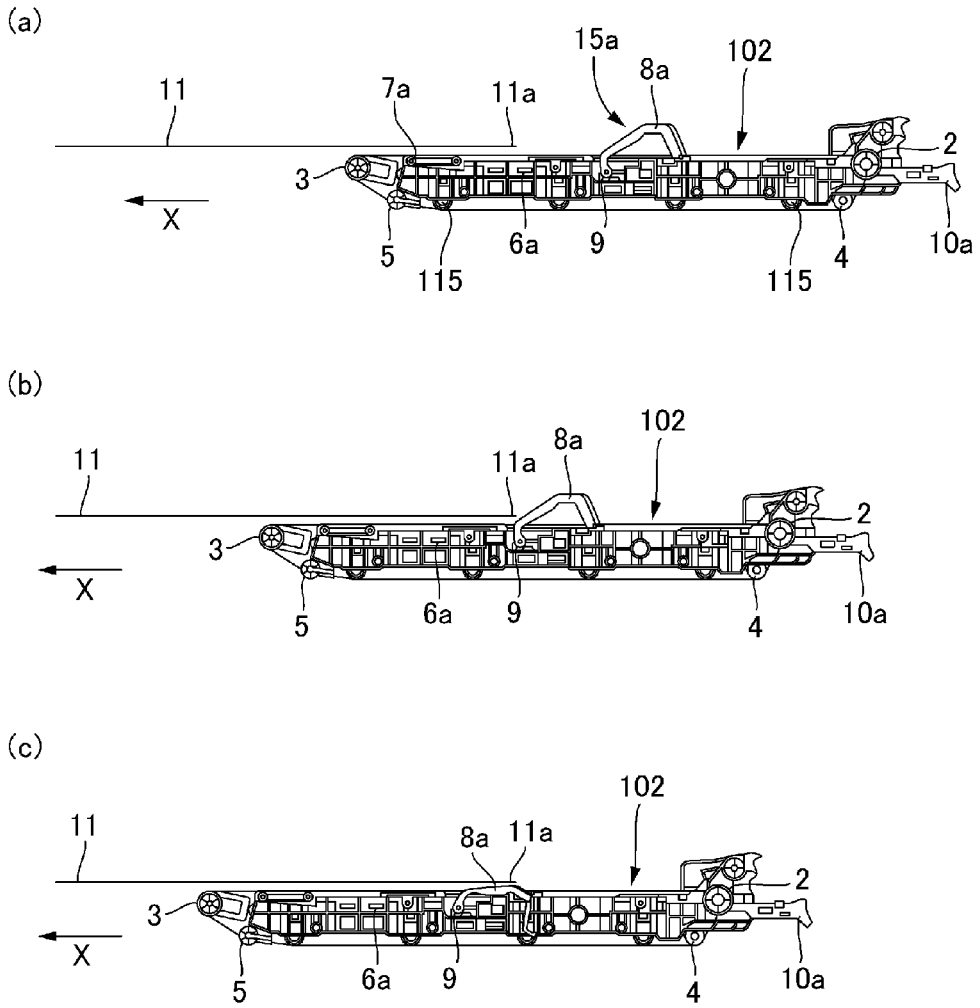
In FIG. 5, parts (a) and (c) are sectional views of the intermediary transfer belt unit, which show the steps through which the intermediary transfer belt unit is inserted into the main assembly of the image forming apparatus.
Figure 6:
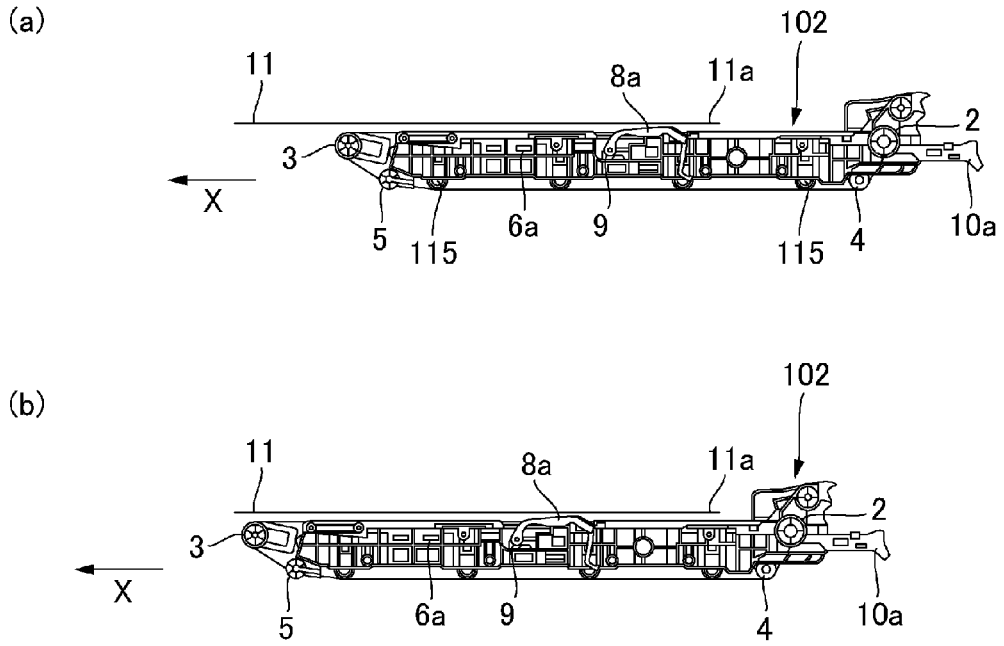
In FIG. 6, parts (a) and (b) are sectional views of the intermediary transfer belt unit, which show the steps through which the intermediary transfer belt unit is inserted into the main assembly of the image forming apparatus.

Next, referring to parts (a)-(c) of FIG. 5 and parts (a) and (b) of FIG. 6, the operation for inserting the belt device 102 into the apparatus main assembly 101*a* is described. Parts (a)-(c) of FIG. 5 and parts (a) and (b) of FIG. 6 show in steps how the belt device 102 is to be inserted into its designated position for image formation, in the apparatus main assembly 101*a*.

Incidentally, although the transportation handle sections 15*a* and 15*b* are positioned at opposite ends of the belt device 102, they are the same in structure. Therefore, they are described with reference to primarily the transportation handle section 15*a*, which is on the front side of the belt device 102.

First, the guiding bosses 7*a* and 7*b* with which the support frames 6*a* and 6*b* are provided, respectively, are guided by the unit guiding rails (part (b) of FIG. 2) with which the apparatus main assembly 101*a* is provided. Thus, the belt device 102 is inserted into the apparatus main assembly 101*a* in the roughly horizontal direction indicated by the arrow mark X (part (a) of FIG. 4). As described before, the apparatus main assembly 101*a* is provided with the pair of handle pressing portions 11 and 11, which will be above the support frames 6*a* and 6*b* and will extend in the direction in which the belt device 102 is inserted, as the belt device 102 is inserted into the apparatus main assembly 101*a*.

That is, part (a) of FIG. 5 shows the state in which the belt device 102 is after an operator has brought the belt device 102 to the apparatus main assembly 101*a* by grasping the handles 8*a* and 8*b*, and has inserted the belt device 102 into the apparatus main assembly 101*a* until the guiding bosses 7*a* and 7*b* fit into the unit guide rails. As the belt device 102, which is in the state shown in part (a) of FIG. 5, is inserted further into the apparatus main assembly 101*a*, it moves in the direction indicated by the arrow mark X, until it moves into its designated position in the apparatus main assembly 101*a*.

In this case, by the way, even after the belt device 102 has been inserted into the apparatus main assembly 101*a* in the direction indicated by the arrow mark X, deep enough for the handles 8*a* and 8*b* to come into contact with the handle pressing portions 11 and 11, the handles 8*a* and 8*b* remain erect, as shown in part (b) of FIG. 5, because of the resiliency of the torsion springs 9*a* and 9*b*.

However, as the belt device 102 is inserted deep enough into the apparatus main assembly 101*a* in the direction indicated by the arrow mark X, for the handles 8*a* and 8*b* to come under the handle pressing portions 11 and 11, from the side of the downstream end portion 11*a*, the handles 8*a* and 8*b* are moved downward into the storage space sp of the support frames 6*a* and 6*b*, by the downstream end portion 11*a* of the handle pressing portion 11, as shown in part (c) of FIG. 5. During this process, the handles 8*a* and 8*b* smoothly pivot toward their inside positions, that is, without hanging up at the handle pressing portions 11 and 11, because the pivotal shaft 20 is on the downstream side of the slanted surface 28 in terms of the direction of the belt device insertion.

Further, while the belt device 102 is inserted in the direction indicated by the arrow mark X into the primary transfer position after the insertion of the belt device 102 into the position shown in part (a) of FIG. 6, the handles 8*a* and 8*b* remain stored in the support frames 6*a* and 6*b*. As the belt device 102 is stopped in its designated position, the operation ends (part (b) of FIG. 6).

[Extraction of Intermediary Transfer Belt Unit from Apparatus Main Assembly]

Figure 7:
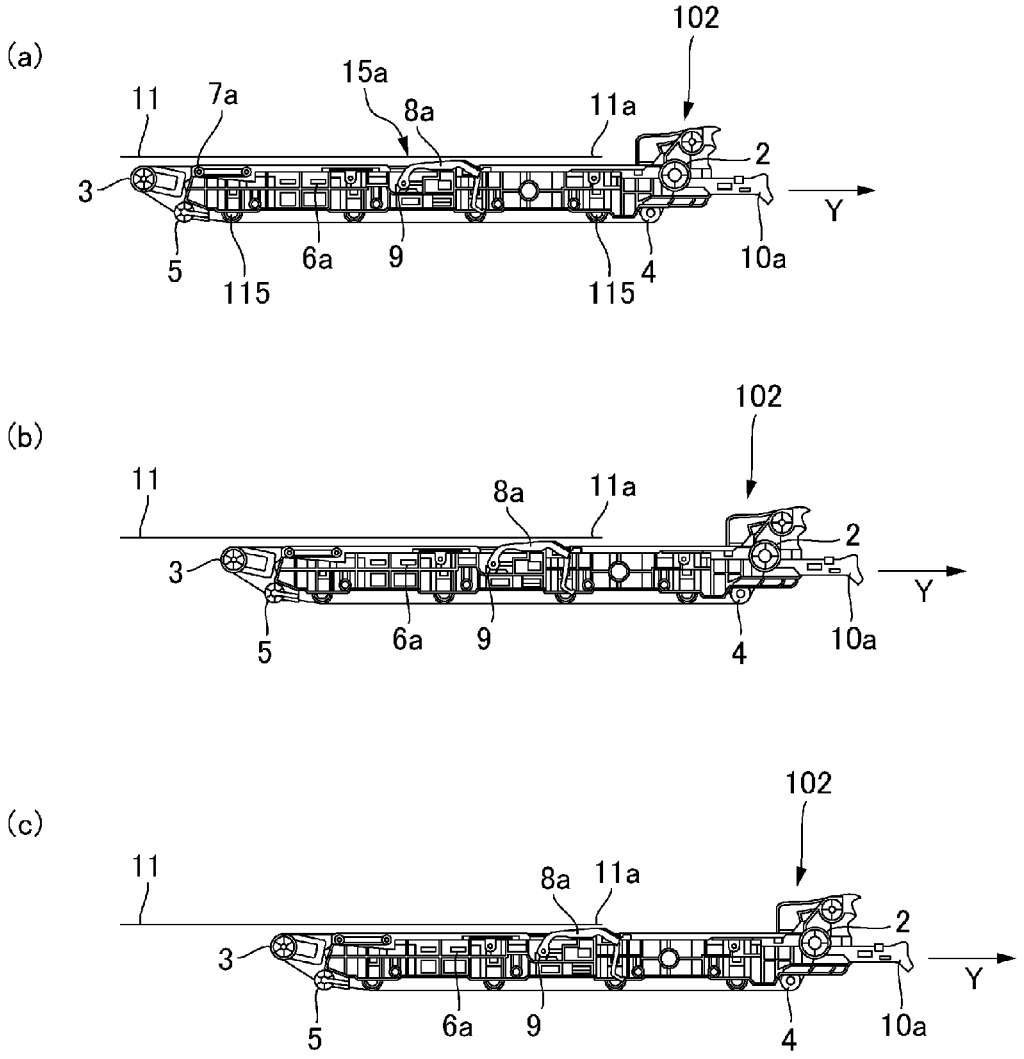
In FIG. 7, parts (a)-(c) are sectional views of the intermediary transfer belt unit, which show the steps through which the intermediary transfer belt unit is pulled out of the main assembly of the image forming apparatus.
Figure 8:
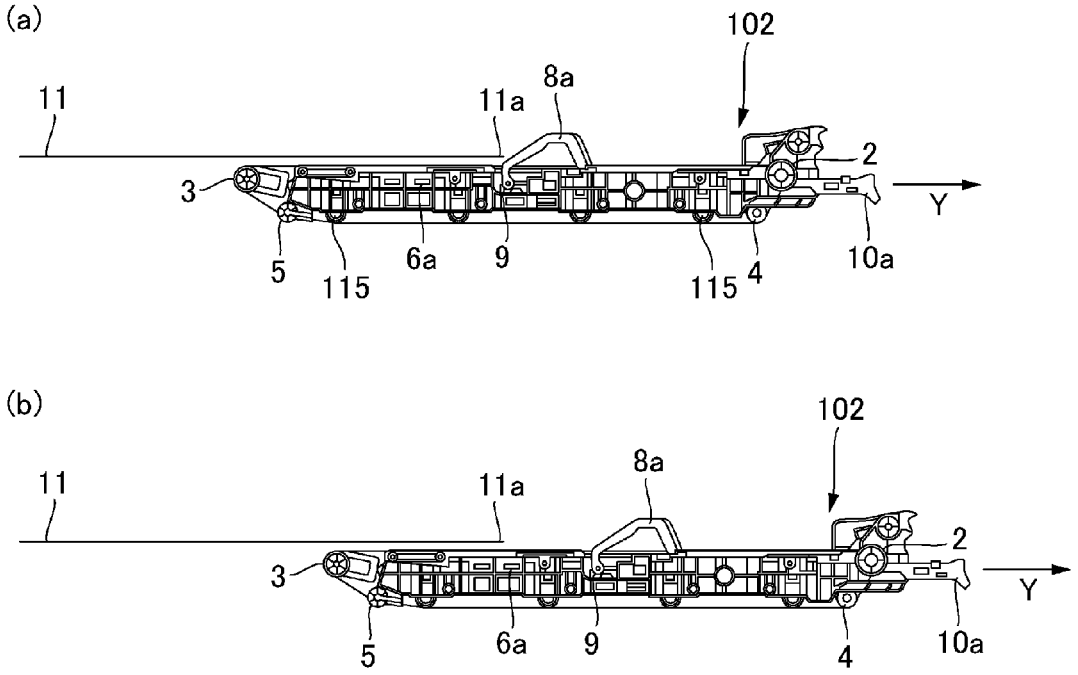
In FIG. 8, parts (a) and (b) are sectional views of the intermediary transfer belt unit, which show the steps through which the intermediary transfer belt unit is pulled out of the main assembly of the image forming apparatus.

Next, referring to parts (a)-(c) of FIG. 7 and parts (a) and (b) of FIG. 8, the operation for extracting (pulling out) the belt device 102 from the apparatus main assembly 101*a* is described. Parts (a)-(c) of FIG. 7 and parts (a) and (b) of FIG. 8 show how the belt device 102 in its designated position in the apparatus main assembly 101*a* is to be pulled out of the apparatus main assembly 101*a*.

The operation for extracting the belt device 102 is carried out similarly to the operation for inserting the belt device 102 into the apparatus main assembly 101*a*. The operator is to grasp the handles 10*a* and 10*b* of the belt device 102, and pull the belt device 102 along the unit guide rails, by the handles 10*a* and 10*b* in the direction indicated by an arrow mark Y until the belt device 102 comes to the position in which the handles 8*a* and 8*b* can be grasped.

That is, until the belt device 102, which is in its designated position in the apparatus main assembly 101*a* as shown in part (a) of FIG. 7, is pulled outward, through the position shown in part (b) of FIG. 7, to the position shown in part (c) of FIG. 7, the handles 8*a* and 8*b* remain in the support frames 6*a* and 6*b*, respectively. When the belt device 102 is in the position shown in part (c) of FIG. 7, the handle 8*a* (8*b*) will have reached the area below the upstream end 11*a* of the handle pressing portion 11.

Then, as the belt device 102 is pulled further in the direction indicated by the arrow mark Y, in the apparatus main assembly 101*a*, as shown in part (a) of FIG. 8, the handle 8*a* (8*b*) passes by the upstream end 11*a*. As the handle 8*a* (8*b*) passes by the upstream end 11*a*, the handle 8*a* (8*b*), which is under the pressure from the torsion spring 9, automatically and pivotally erects.

As the handle 8*a* (8*b*) erects as described above, it becomes very easy to see to transport the belt device 102. Then, after the belt device 102 is pulled out in the direction indicated by the arrow mark Y to the position shown in part (b) of FIG. 8, the operator is to grasp the handle 8*a* (8*b*) so that the belt device 102 can be quickly transported.

In the case of this embodiment, the transportation handle sections 15*a* and 15*b* are attached to the support frames 6*a* and 6*b* so that they outwardly offset from the intermediary transfer belt 1 in terms of the width direction of the intermediary transfer belt 1; are storable in the storage portion 33 when the belt device 102 is inserted into the apparatus main assembly 101*a*; and can be made to protrude when the belt device 102 is pulled out of the apparatus main assembly 101*a*. That is, the belt device 102 in this embodiment can be reduced in the height of the intermediary transfer belt unit 103. Further, the handles 8*a* and 8*b* regulate their movement relative to the handle pressing portions 11 and 11 by themselves. Therefore, it is smaller in component count and cost. That is, the present invention can reduce a belt device in component count and cost.

Further, a belt device of the conventional type is problematic in that the apparatus main assembly 101*a* requires a substantial amount of space for belt unit insertion. In comparison, in the case of the belt device 102 in this embodiment, the handles 8*a* and 8*b* retract into the support frames 6*a* and 6*b*, respectively. Therefore, the abovementioned space is substantially smaller. That is, this embodiment can minimize in size the above-described space.

Incidentally, in the case of this embodiment, the present invention was applied to a combination of the image forming apparatus 101 and belt device 102, which is of such a type that one of the lateral walls of the apparatus main assembly 101*a* is provided with the door 31 which is to be opened to insert the belt device 102 into the apparatus main assembly 101*a* or extract the belt device 102 from the apparatus main assembly 101*a*. However, the application of the present invention is not limited to an image forming apparatus of the above-described type. That is, the present invention is also applicable to an image forming apparatus, of such a type that the apparatus main assembly 101*a* is vertically opened or closed.

The application of the present invention is not limited to a color printer of the so-called tandem type, such as the one in this embodiment. That is, the present invention is also applicable to various image forming apparatuses other than the one in this embodiment, such as a monochromatic copying machine, a digital multifunction machine, a facsimile machine, a laser printer, etc., which employ a unit which can be inserted into, or extracted from, their main assembly.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Application No. 193727/2013 filed Sep. 19, 2013, which is hereby incorporated by reference herein in its entirety.

What is claimed is:

1. An image forming apparatus comprising:

a main assembly;

a belt unit configured to be detachably mountable to said main assembly, said belt unit comprising:

a movable endless belt;

supporting rollers configured to support said endless belt;

a supporting frame configured to support said supporting rollers;

a grip member provided on said supporting frame at a position outside of said belt with respect to a widthwise direction of said belt, when said belt unit is mounted in said main assembly, and configured to be rotatable between a first position in which said grip member is projected out of an accommodating portion of said supporting frame in an upward direction and a second position in which said grip member is accommodated in the accommodating portion; and an urging member configured to urge said grip member from the second position toward the first position, said belt unit configured to be inserted into and removed from said main assembly through an opening portion in a direction substantially perpendicular to the widthwise direction of said belt, the opening portion being provided in a lateral side portion of said main assembly;

an image forming unit provided in said main assembly and configured to form an image on said belt; and a pressing portion provided in said main assembly and configured to press said grip member directly to move said grip member from the first position to the second position with the insertion of said belt unit into said main assembly, said pressing portion being positioned at a pressing position outside of said belt with respect to the widthwise direction of said belt and being configured to be disengaged from said grip member to permit said grip member to move from the second position to the first position by an urging force of said urging member upon removal of said belt unit.

2. The image forming apparatus according to claim 1, wherein said grip member includes a rotation supporting shaft extending in the widthwise direction and configured to support a first end of said grip member so that said grip member is rotatable between the first position and the second position, and a guide locking portion configured to guide a second end of said grip member in the movement of said grip member between the first position and the second position and configured to lock the second end at the first position to permit transportation of said belt unit.

3. The image forming apparatus according to claim 2, wherein said urging member includes an elastic member, and said guide locking portion includes an engaging claw provided on the second end of said grip member and a locking claw provided in said accommodating portion and configured to engage with said engaging claw.

4. The image forming apparatus according to claim 2, wherein said rotation supporting shaft is disposed at a downstream side of said belt unit with respect to an inserting direction of said belt unit into said main assembly.

5. The image forming apparatus according to claim 1, wherein said grip member is provided in plural at each of end portions of said supporting frame with respect to the widthwise direction, and said grip members are disposed at substantially symmetrical positions with respect to a gravity center of said belt unit.

6. The image forming apparatus according to claim 1, wherein directions of the insertion and the removal of said belt unit are substantially horizontal when said belt unit is in place in said main assembly.

7. The image forming apparatus according to claim 1, further comprising a second grip provided on said supporting frame and configured to facilitate the insertion and the removal of said belt unit relative to said main assembly.

8. The image forming apparatus according to claim 1, wherein said supporting member is provided with a reinforcing rib projecting in the widthwise direction of said belt and provided at a position corresponding to a lower part of said grip member when said grip member is in the second position, a rotational axis of said grip member extends in the widthwise direction of said belt, and said grip member includes a grip portion extending convexly upward from a first end thereof to a second end thereof as viewed in the widthwise direction of said belt, and wherein said reinforcing rib is in said belt as seen in the widthwise direction of said belt, and at least a part of said reinforcing rib is in an area defined by said grip member and a line connecting the first end and the second end of said grip member.

9. The image forming apparatus according to claim 1, wherein said supporting frame includes a regulating portion for regulating rotation of said grip member by contacting said grip member, and said regulating portion is provided with a guiding portion for guiding said grip member.

10. The image forming apparatus according to claim 1, wherein said supporting frame includes a locking portion for locking said grip member when said grip member is in the second position.

* * * * *